US006748773B2

(12) United States Patent
Alchin et al.

(10) Patent No.: US 6,748,773 B2
(45) Date of Patent: Jun. 15, 2004

(54) LOCK

(75) Inventors: Michael B. Alchin, Mittagong (AU); Perry R. Long, Smithfield (AU)

(73) Assignee: Doric Products Pty Limited, Wetherill Park (AU)

( * ) Notice: Subject to any disclaimer, the term of this patent is extended or adjusted under 35 U.S.C. 154(b) by 0 days.

(21) Appl. No.: 10/302,718

(22) Filed: Nov. 22, 2002

(65) Prior Publication Data

US 2004/0079123 A1 Apr. 29, 2004

(30) Foreign Application Priority Data

Nov. 23, 2001 (AU) ..... PR9085

(51) Int. Cl.[7] ..... E05B 65/08; E05B 13/00

(52) U.S. Cl. ..... 70/99; 70/100; 70/137; 70/210; 70/224; 70/DIG. 60

(58) Field of Search ..... 70/DIG. 60, 95–100, 70/208, 210, 224, 137, 139, 475, 478, 479, 484, 485

(56) References Cited

U.S. PATENT DOCUMENTS 722,622 A * 3/1903 Phelps ..... 70/475
1,500,168 A * 7/1924 Voight ..... 70/92
2,563,985 A * 8/1951 Yachzel ..... 70/129
2,769,330 A * 11/1956 O'Connell ..... 70/97
2,810,284 A * 10/1957 Wartian ..... 70/99
3,594,031 A * 7/1971 Ford ..... 292/140
3,890,813 A * 6/1975 Cothron ..... 70/92
6,067,823 A * 5/2000 Ostergren ..... 70/210
6,122,946 A * 9/2000 Blanch ..... 70/473
6,360,569 B1 * 3/2002 Huang ..... 70/215
6,502,435 B2 * 1/2003 Watts et al. ..... 70/95

* cited by examiner

*Primary Examiner*—Lloyd A. Gall
(74) *Attorney, Agent, or Firm*—Townsend and Townsend and Crew LLP

(57) ABSTRACT

A lock 10 to be mounted in a sliding door or window. The lock 10 includes a lever 17 that is used to retract and extend the locked tongue member 15. On the inside of the door there is provided a first cylinder lock 24 that is operable to release the tongue member 15 for movement from the extended position to the retracted position thereof while provided on the outside of the door is a lock cylinder 27 that is operable to lock or to release the tongue member 15 for movement from the extended position to the retracted position and operable to move the tongue member 15 between the extended and retracted positions thereof.

20 Claims, 9 Drawing Sheets

LOCK

TECHNICAL FIELD

The present invention relates to locks and more particularly but not exclusively to door locks.

BACKGROUND OF THE INVENTION

Known deadlocks enable a user by operation of a key to "deadlock" the lock from the inside. This creates a problem in that should a person inside be unable to locate a key they will not be able to exit. This is of particular danger should a fire occur.

Described in Australian Patents 702534 and 692915 are locks having the above problem.

Frequently locks, such as the lock of Patent 692915 are configured such that a user entering from the outside by use of a key disables the deadlock mechanism so that a person cannot accidentally lock themselves inside by merely closing the door.

OBJECT OF THE INVENTION

It is the object of the present invention to overcome or substantially ameliorate the above disadvantage.

SUMMARY OF THE INVENTION

The lock includes:

a lock tongue member movable between an extended striker engaging position and a retracted position;

an actuator on a first side of said lock and which is manipulated by a user to move the tongue member from the extended position to the retracted position;

a lock mechanism operatively associated with said actuator and being arrangable in a first configuration and a second configuration, said mechanism wherein said first configuration permitting operation of said actuator to move the tongue member from the extended position to the retracted position, while wherein said second configuration rendering said actuator ineffective in respect of moving said tongue member from said extended position to said retracted position;

a first key operable lock cylinder, said first cylinder being on said first lock side and operatively associated with said lock mechanism;

a second key operable lock cylinder, said second cylinder being on a second side of said lock and operatively associated with said lock mechanism; and wherein said lock mechanism is responsive to operation of said first cylinder by a user to be arranged in said first configuration but not said second configuration, while being responsive to operation of said second cylinder by a user to be arranged by choice of said user in said first configuration or said second configuration.

Preferably the tongue member includes a tongue portion and a base portion, with the base portion mounting the tongue member for angular movement between the extended and the retracted positions of the tongue member, with the tongue portion being of a hook configuration.

Preferably the lock further includes a projection movable, relative to the tongue member, between a first position retaining the tongue member in the extended position and providing said second configuration, and a second position permitting movement of the tongue member and providing said first configuration, and a cam member mounted for angular movement to cause movement of the projection between the first and second positions thereof, with said cam member and projection being part of said lock mechanism and moved by operation of the first and second cylinders.

Preferably each cylinder includes a barrel, with the barrels, tongue member and cam member being angularly movable about a common axis.

Preferably the lock further includes a pawl mounted on said cam member, the pawl being adapted to prevent operation of said first cylinder to arrange said lock mechanism in said second configuration.

Preferably said pawl is movable parallel to said axis between a first position at which said cam member is movable by said first cylinder, and a second position at which said first cylinder is incapable of moving said cam member.

Preferably said fist cylinder when moved angularly in a first direction moves the pawl to the pawl second position so that angular movement of the first cylinder in said first direction does not move said cam member, while angular movement of said first cylinder in the opposite angular to said first direction causes engagement of the first cylinder with the pawl to thereby move the cam member and thus movement of said projection from the projection first position to the projection second position.

Preferably the lock further includes a spring urging said pawl in the pawl first position.

Preferably the lock further includes a spring urging said projection to the first position thereof.

In a further preferred form the lock further includes:

a recess in said tongue member;

a projection movable with respect to said tongue member between a first position at which the projection is located in the recess preventing movement of the tongue member and thus providing said second configuration, and a second position spaced from the recess so as to permit movement of the tongue member and thus providing said second configuration;

a cam member operatively associated with the projection to cause movement of the projection between the first and the second positions thereof; and wherein the first cylinder is operatively associated with the cam member so that the cam member can only be driven in one rotational direction by the first cylinder, with angular movement of the cam member in said one direction providing for movement of the cam member to cause movement of said projection to release the tongue member, while said second cylinder is operatively associated with the cam member so as to be operable to drive the cam member in both rotational directions to thereby provide for movement of said projection to either of the positions thereof.

Preferably the lock further includes a pawl mounted on said cam member, the pawl being adapted to prevent operation of said first cylinder to arrange said lock mechanism in said second configuration.

Preferably said cam member is angularly moved about an axis, and said pawl is movable parallel to said axis between a first position in which the cam member is movable by said first cylinder, and a second position at which said cam member is incapable of moving said cam member.

Preferably rotational operation of the said first lock cylinder in one angular direction only, changes the operative configuration of the lock mechanism, while rotational operation of said second lock cylinder in either angular direction changes the operative configuration of said lock mechanism.

Preferably the lock further includes a projection movable, relative to the tongue member, between a first position retaining the tongue member in the extended position and providing said second configuration, and a second position permitting movement of the tongue member and providing said first configuration, and a cam member mounted for angular movement about an axis and to cause movement of the projection between the first and second positions thereof, with said cam member and projection being part of said lock mechanism and moved by operation of the first and second cylinders.

Preferably the lock further includes a pawl mounted on said cam member, the pawl being adapted to prevent operation of said first cylinder to arrange said lock mechanism in said second configuration.

Preferably said pawl is movable parallel to said axis between a first position at which said cam member is movable by said first cylinder, and a second position at which said first cylinder is incapable of moving said cam member.

Preferably said tongue member pivots about said axis to move between the tongue extended and retracted positions.

Preferably the lock cylinders are co-axial with respect to said axis.

Preferably said actuator is rendered ineffective to move the tongue to the retracted position by said tongue member being retained in the extended position.

Preferably said actuator is a lever that pivots about said axis to move the tongue member.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
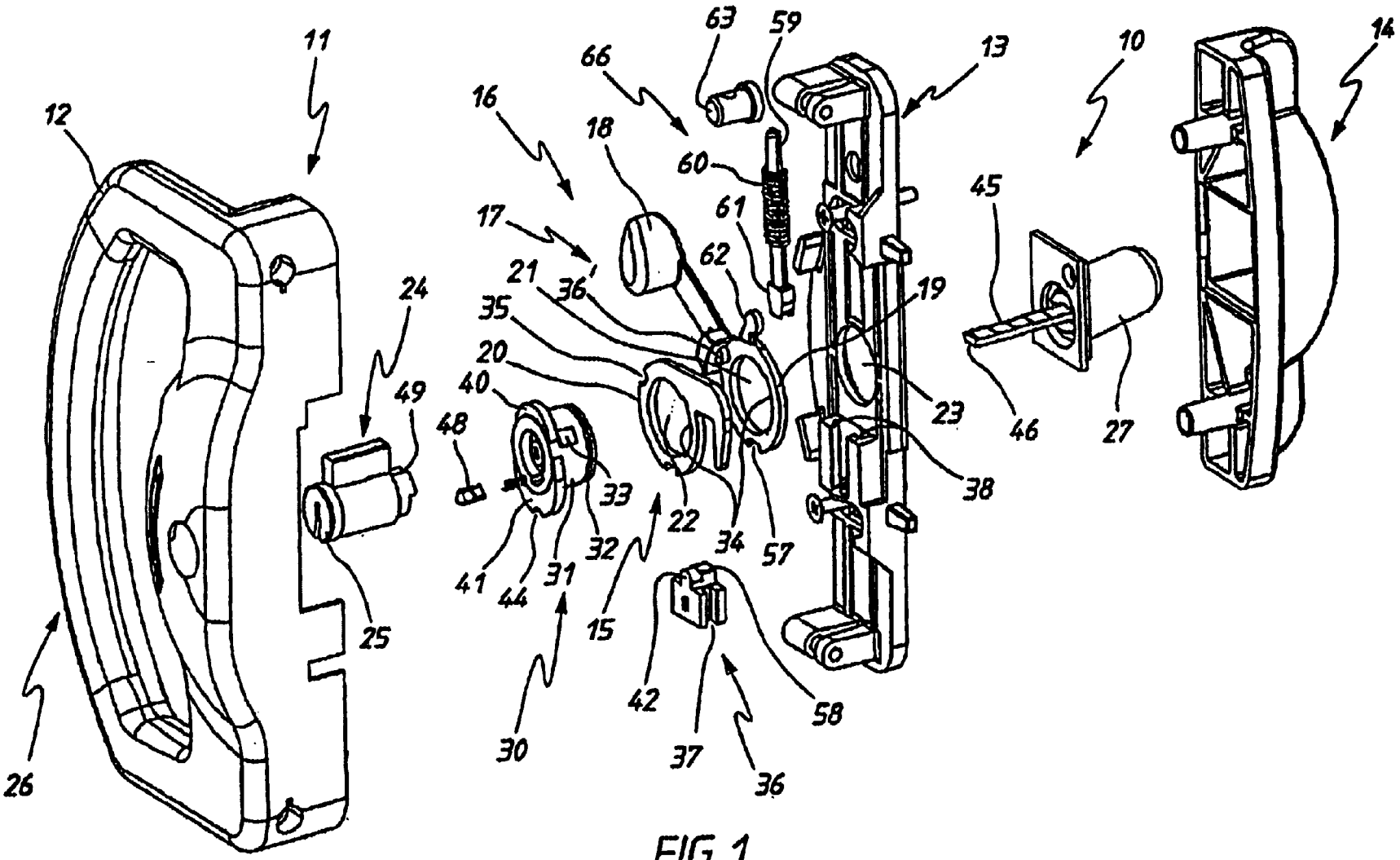
FIG. 1 is a schematic parts exploded perspective view of a lock for a sliding door or window.
Figure 2:
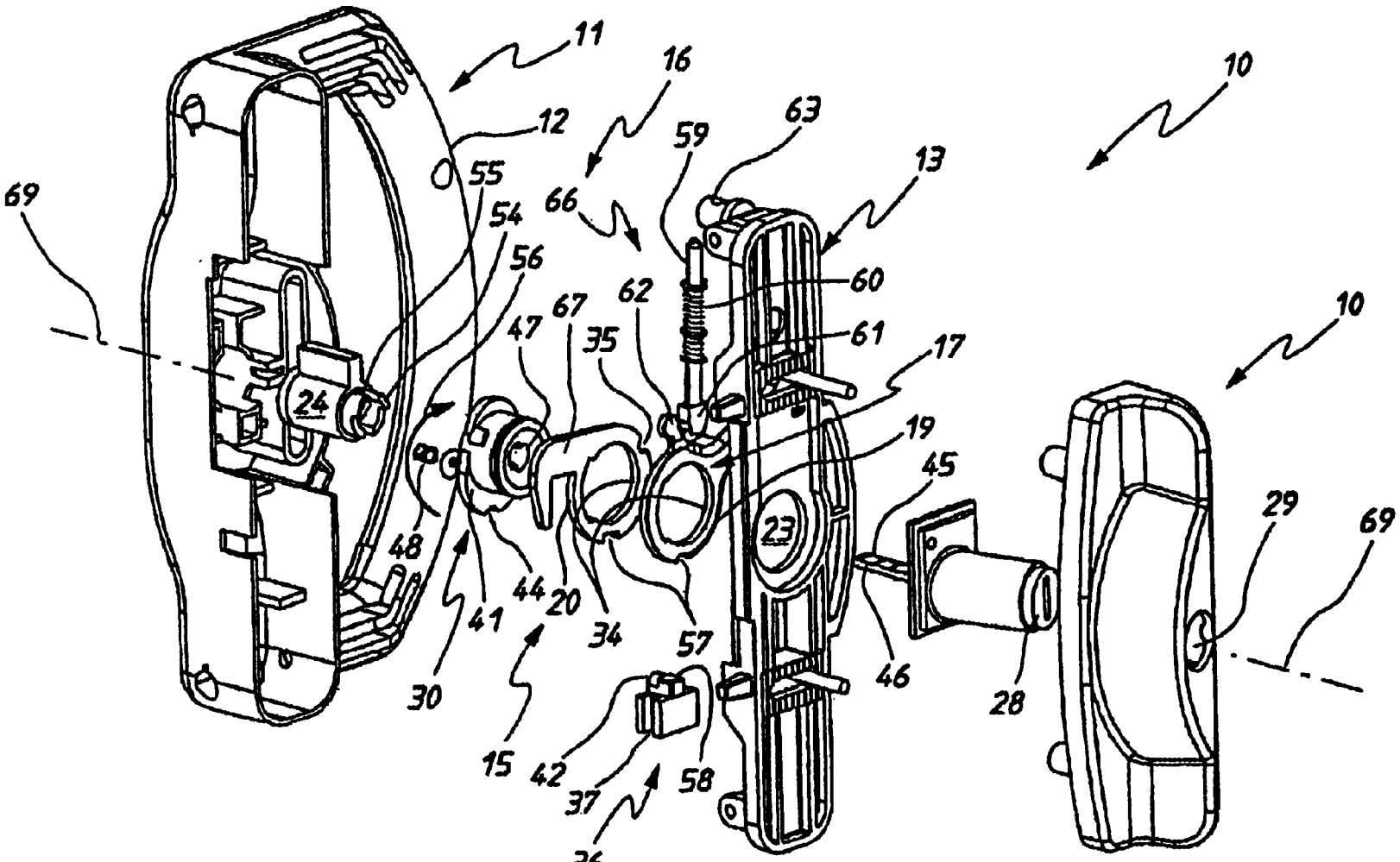
FIG. 2 is a schematic parts exploded perspective view of the lock of FIG. 1.
Figure 3:
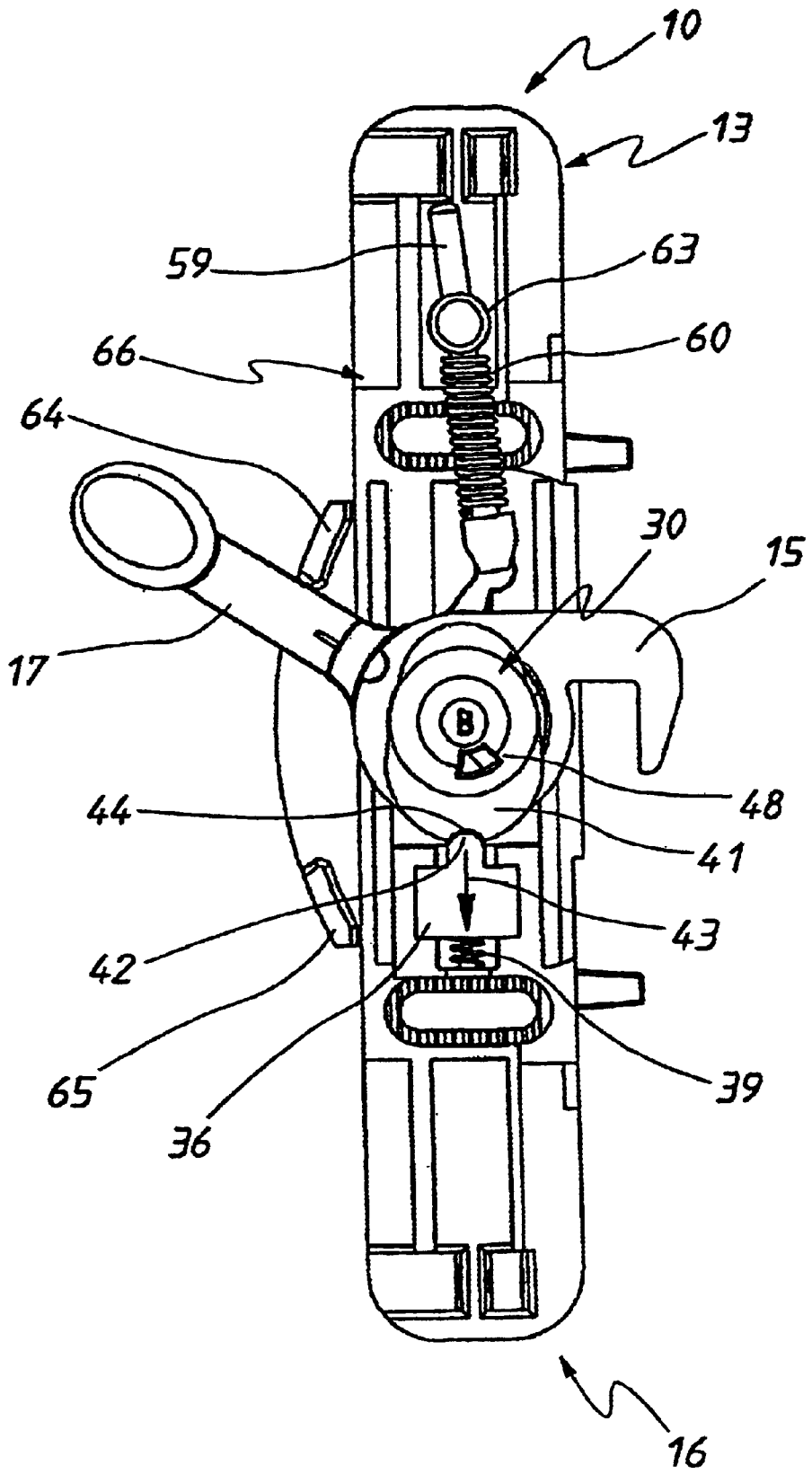
FIG. 3 is a schematic front elevation of the lock mechanism of the lock of FIG. 1.
Figure 4:
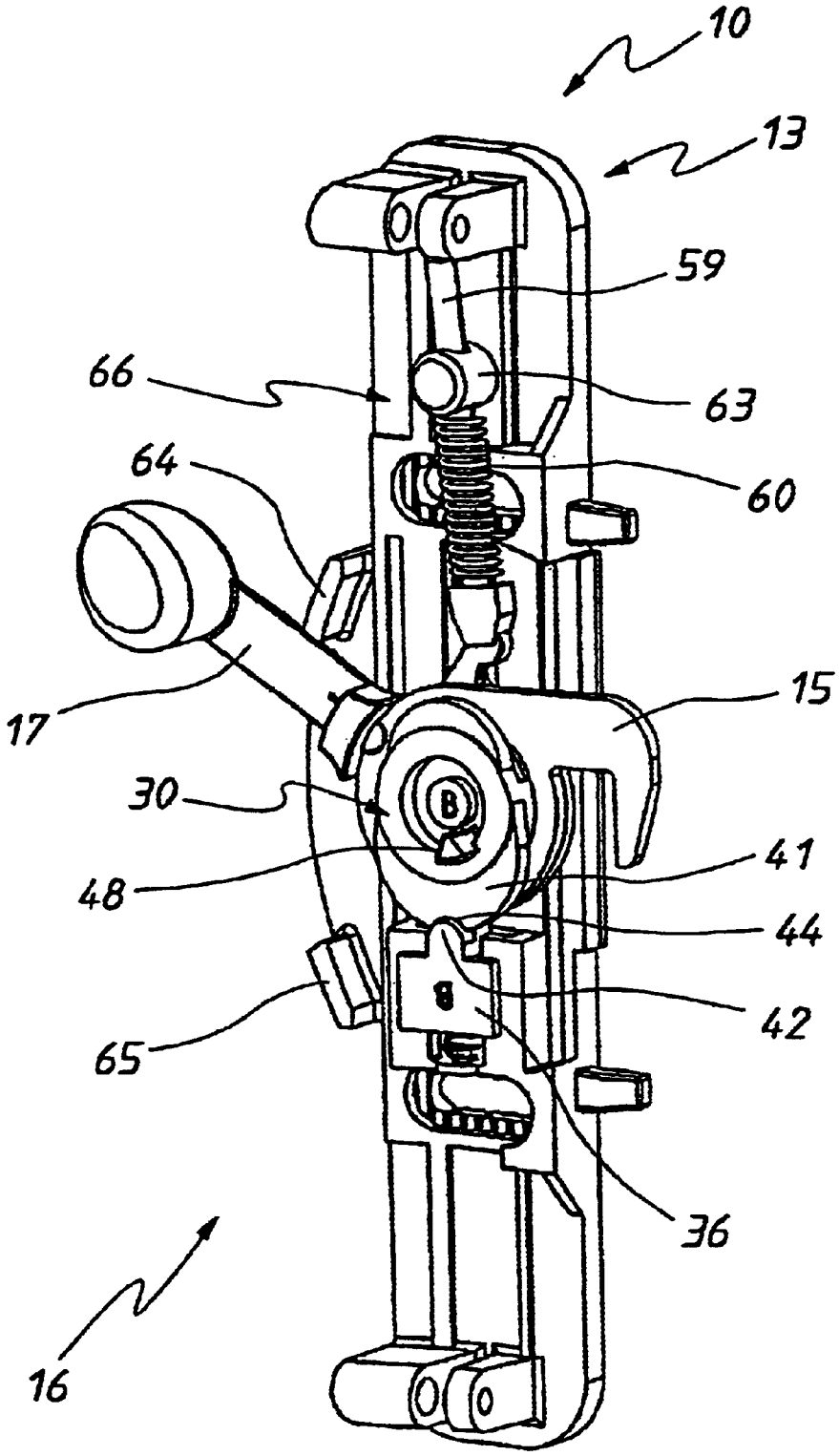
FIG. 4 is a schematic perspective view of the lock mechanism as shown in FIG. 3.

In FIGS. 1 to 10 of the accompanying drawings there is schematically depicted a lock 10. The lock 10 is intended to be mounted on a sliding door or window. However it should be appreciated that the present invention can be employed in other types of locks. The lock 10 includes a body 11 having a handle 12 which is secured to a base 13. Typically, the body 11 would be mounted on the inside of the door, while mounted on the outside of the door is a further handle 14. Accordingly, one side of the lock 10 corresponds to the inside of the door while the other side of the lock 10 corresponds to the outside of the door.

Mounted on the base 13 is a lock tongue member 15 which is of a "hook" configuration. The tongue member 15 is angularly movable about an axis 69 between an extended position shown in FIG. 3, FIG. 4, FIG. 7, FIG. 8 and FIG. 9, and a retracted position shown in FIG. 5, FIG. 6 and FIG. 10. In the extended position, the tongue member 15 would typically be engaged with a striker to retain the door in the closed position.

Mounted on the base 13 is a lock mechanism 16. The mechanism 16 includes an actuator in the form of a lever 17. The lever 17 is operatively associated with the tongue member 15 and is manipulated by a user to move the tongue 15 between the extended and retracted positions. The lever 17 has an end 18 which would be gripped by a user, and an annular portion 19 via which the lever 17 is mounted for angular movement. In this respect it should also be noted that the tongue member 15 has an annular portion 20 which is part of the base 68 and which is aligned with the portion 19 so as to be generally coaxial with respect thereto. The portions 19 and 20 have circular apertures 21 and 22 respectively which are aligned with a circular aperture 23 in the base 13. The lever 17 and tongue member 15 are angularly moved about the axis 69.

On the inside of the lock 10 there is provided a key operated lock cylinder 24 that has a face 25 protruding through an aperture 26 in the body 11, while on the outside of the lock 10 there is provided a key operated cylinder 27 having a face 28 that protrudes through an aperture 29 in the outside handle 14. The cylinders 24 and 27 are operatively associated with a cam member 30 and have lock barrels angularly movable about the axis 69 by operation of a key, which lock barrels cause movement of the cam member 30. The cam member 30 has a circular mounting barrel 31 upon which the portions 19 and 20 are mounted so that the barrel 31 projects through the apertures 21 and 22. Still further, the barrel 31 projects through the aperture 23 in the base 13. A resilient clip (not illustrated) engages within a groove 32 to retain the cam member 30 attached to the base 13 and the tongue member 15 and lever 17 also mounted on the base 13 for angular movement as described above. Accordingly the cam member 30 is movable angularly about the axis 69.

The cam member 30 has a projection 33 that is located within the aperture 22 so as to move in the angular recess 34 of the portion 20. The angular recess 34 has angular limits that are abutted by the projection 33 to cause movement of the tongue member 15 upon angular movement of the cam member 30.

The tongue member 15 has a tongue portion 67 and a base 68 with a peripheral groove 35 which receives a projection 35' on the portion 19, so that the tongue member 15 moves with operation of the lever 17. The tongue portion 67 is of the above mentioned hook configuration and is intended to engage the striker.

Engaged by the cam member 30 is a cam follower 36, which follower 36 has a pair of grooves 37, each of which receives a flange 38 so that the cam follower 36 is guided in its linear movement relative to the base 13. A spring 39 urges the cam follower 36 into engagement with the cam member 30.

The cam member 30 has a retaining portion 40, and a cam 41 that engages an arcuate surface 42 of the cam follower 36. The cam 41 has a recess 44 within which the surface 42 is received to be inhibited from movement relative to the cam member 30 when engaged therein.

Extending from the inner end of the cylinder 27 is a metal strip 45 having an extremity 46 received within a shaped recess 47 in the cam member 30. By use of a key the cylinder 27 can be used to cause angular movement of the cam member 30. However, it should be appreciated that there is some lost motion between operation of the cylinder 27 and movement of the cam member 30 due to the shape of the recess 47 and the shape of the strip 45. However, the recess 47 sets angular limits in respect of this lost motion so that movement beyond these angular limits by the strip 45 will cause angular movement of the cam member 30.

Mounted in the cam member 30 is a pawl 48 that cooperates with the inner end 49 of the cylinder 24. The pawl 48 is slidably received within a recess 50 of the cam member 30 and is urged outwardly by means of a spring 51. The pawl 48 has a ramp surface 52 and an abutment surface 53.

The end 49 has projections 54 and 55, with the projection 54 being provided to engage the surface 52 to cause longitudinal movement inwardly of the pawl 48 so that angular movement of the cylinder 24 in the direction of the arrow 56 cause the pawl 48 to move inwardly and render the cylinder 24 ineffective in respect of moving the cam member 30. However, angular movement of the cylinder 24 in the opposite direction to the arrow 56 causes engagement of the projection 54 with the surface 53 and subsequent angular movement of the cam member 30.

To retain the tongue member 15 in the extended (striker engaging) position there is provided in the tongue member 15 a recess 57 that receives a projection 58 of the cam follower 36. In this respect, it should be appreciated that the portion 19 also has the angular recess 34 as well as the recess 57.

Urging the tongue member 15 to its displacement extremities (that is the retracted position and the extended position) is a spring assembly 66 which includes a mounting rod 59 about which there is positioned a spring 60. The rod 59 has an end socket 61 that engages a projection 62 of the lever 17. The other end of the rod 59 is slidably received within a guide 63 pivotally mounted in the base 13. The spring 60 is compressed between the guide 63 and socket 61 so as to urge the lever 17 (and therefore the tongue member 15) to locate the tongue member 15 in either the extended position or the retracted position. For example, when in the extended position, the spring 60 urges the tongue member 15 to remain in that position. When the lever 17 (or either cylinder 24 or 27) is operated to pivot the tongue member 15 toward the retracted position, the assembly 66 will ultimately reach an "over centre" position where at farther movement of the tongue member 15 to the retracted position will cause the assembly 66 to urge the tongue member 15 to the retracted position. Movement of the tongue member 15 from the retracted position to the extended position causes the opposite to occur in that when the over centre position is passed, the assembly 66 will then act to urge the tongue member 15 to the extended position.

Figure 5:
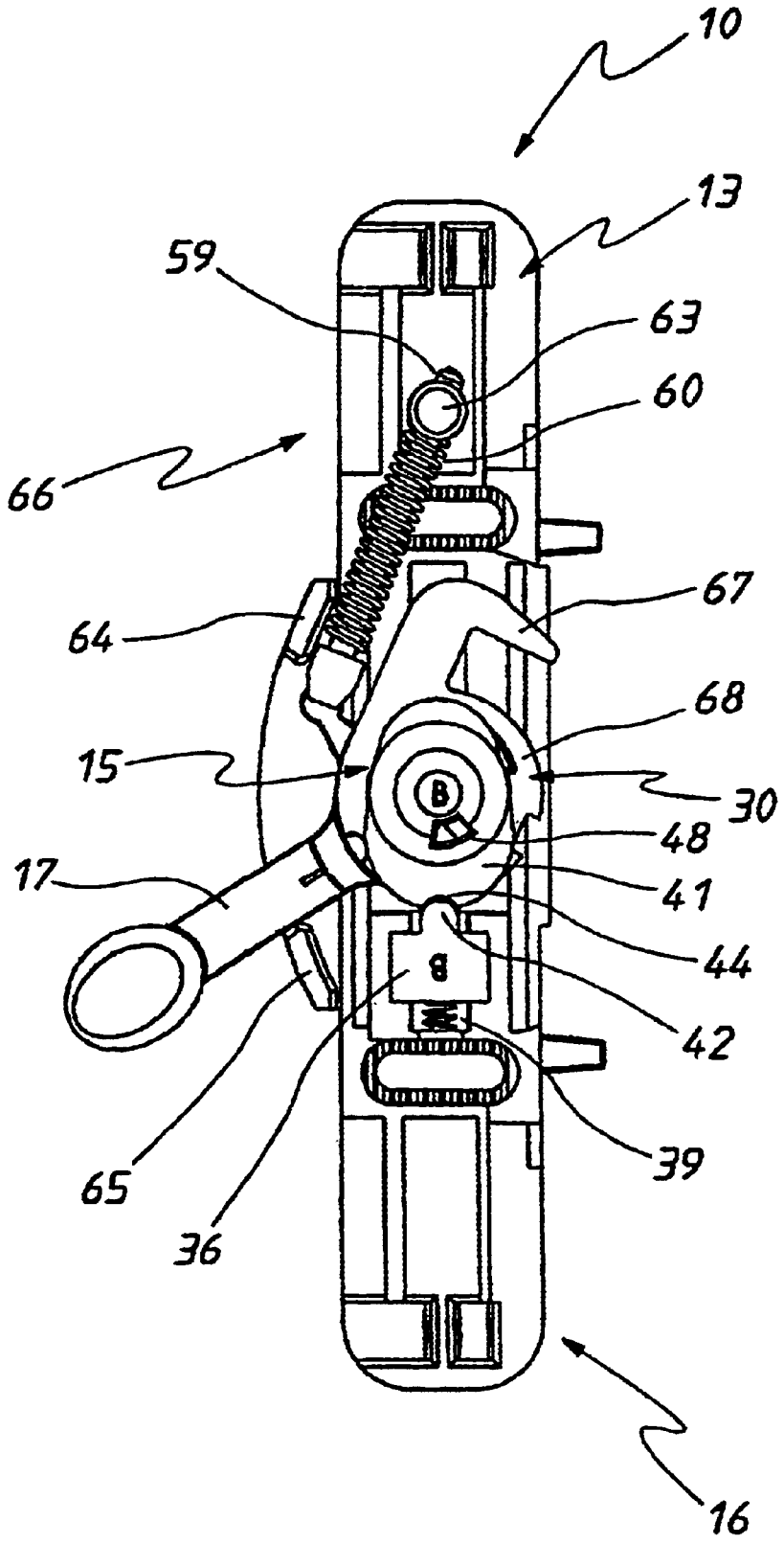
FIG. 5 is a schematic front elevation of the lock mechanism of FIG. 3 in a further operative configuration.
Figure 6:
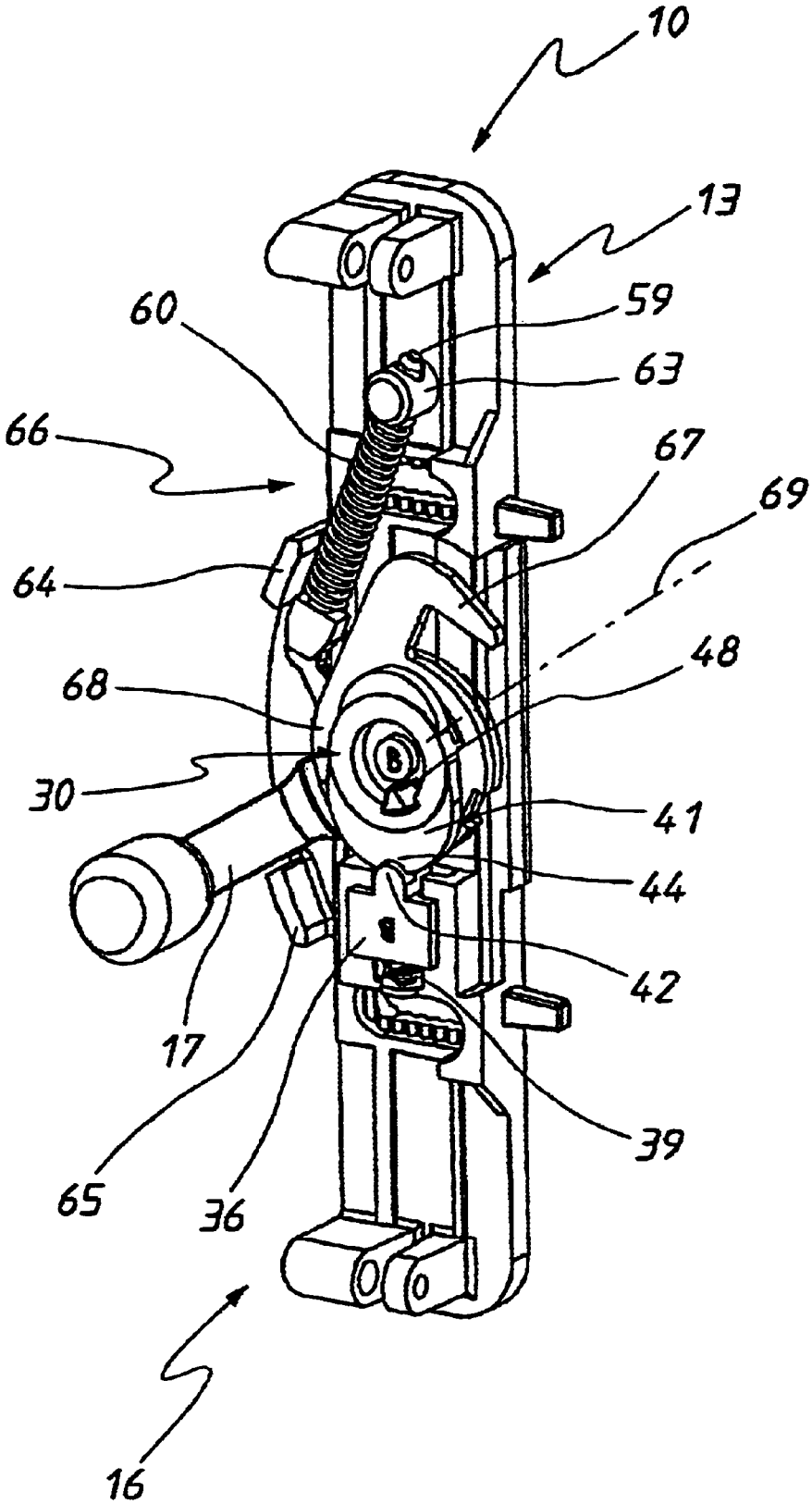
FIG. 6 is a schematic perspective view of the lock mechanism as illustrated in FIG. 5.
Figure 7:
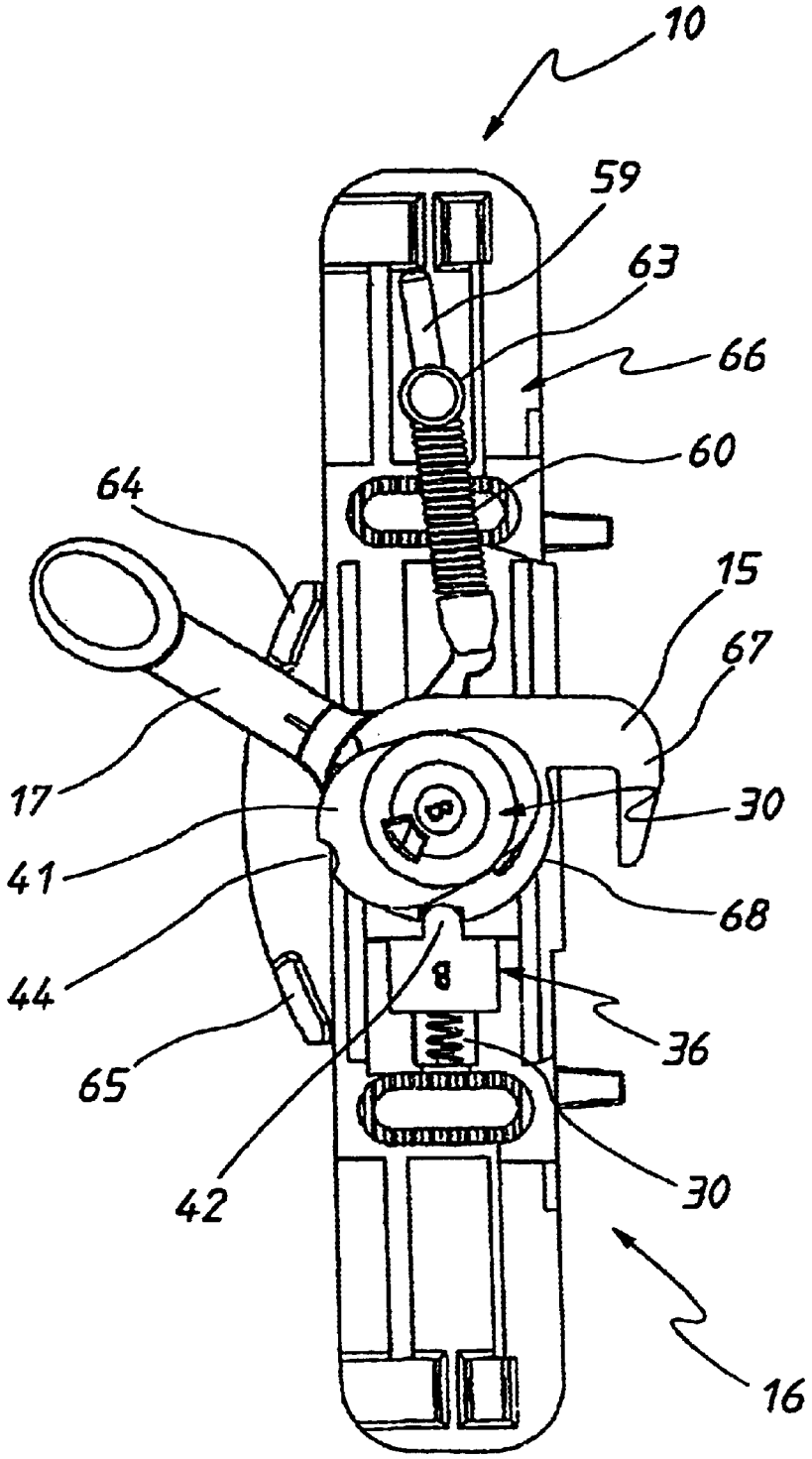
FIG. 7 is a schematic front elevation of the lock mechanism of FIG. 3 in a further operative configuration.
Figure 8:
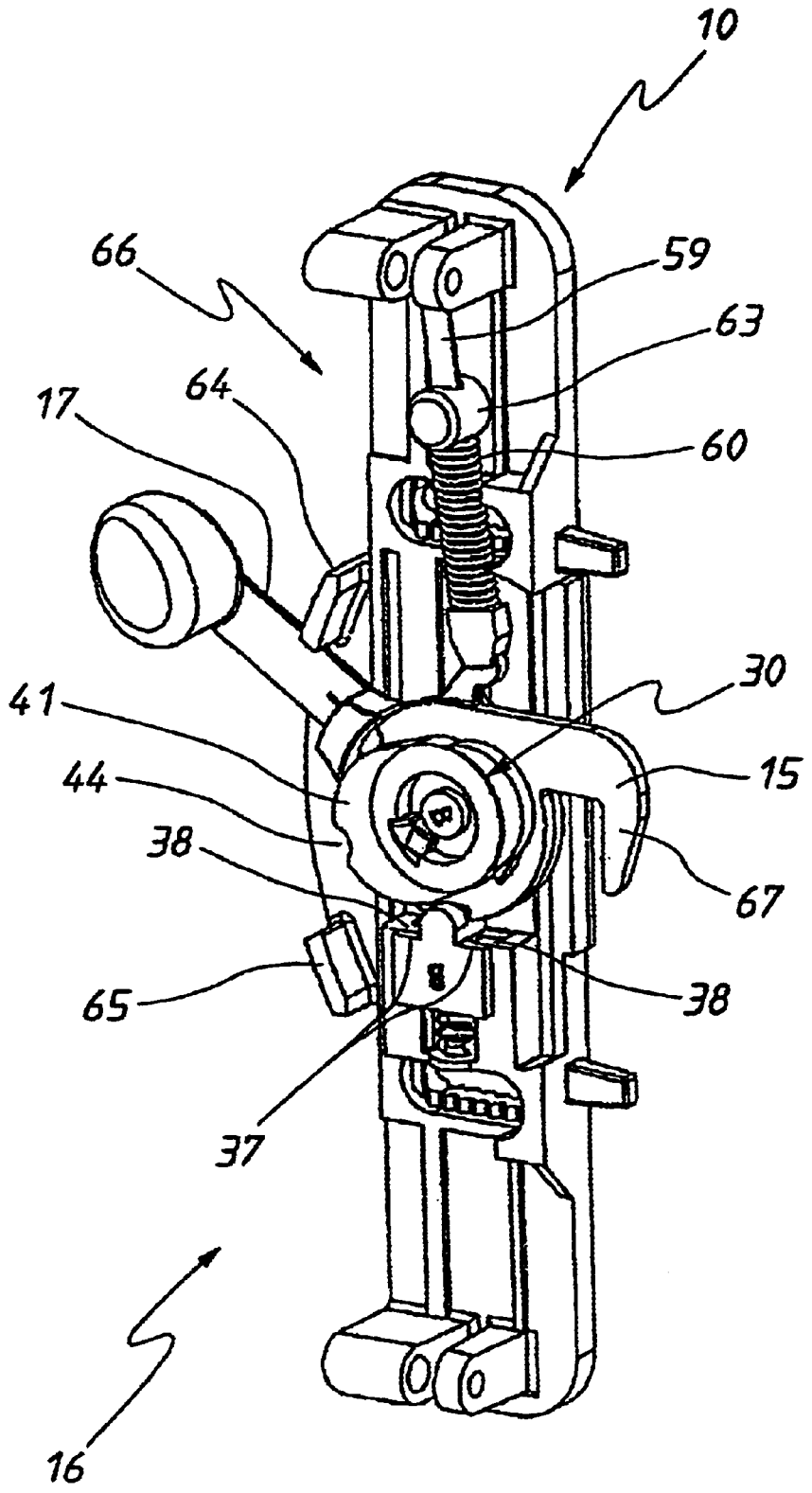
FIG. 8 is a schematic perspective view of the lock mechanism as shown in FIG. 7.
Figure 9:
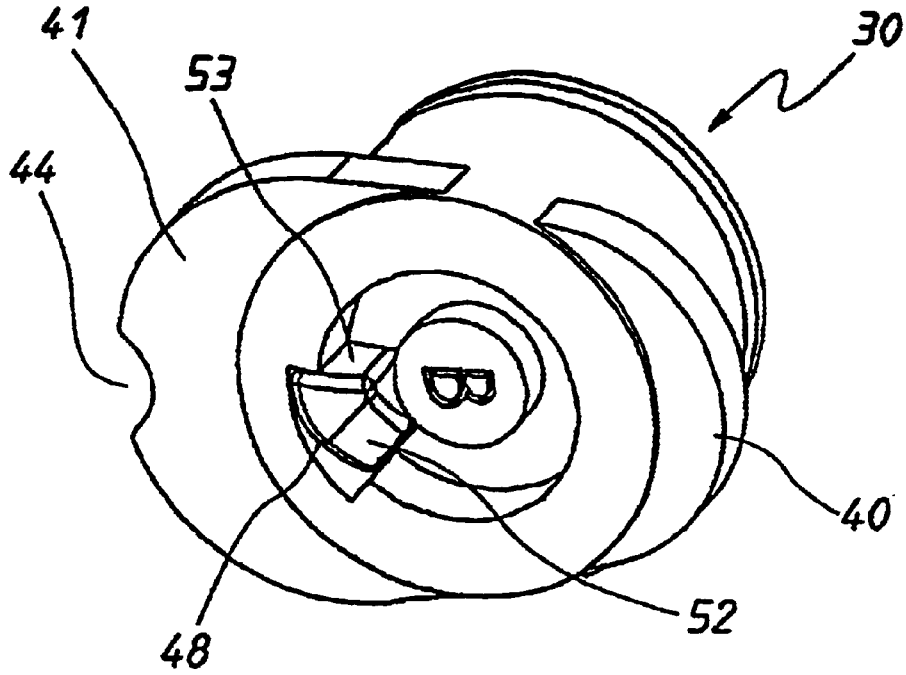
FIG. 9 is a schematic perspective view of a cam member employed in the lock of the previous drawings.
Figure 10:
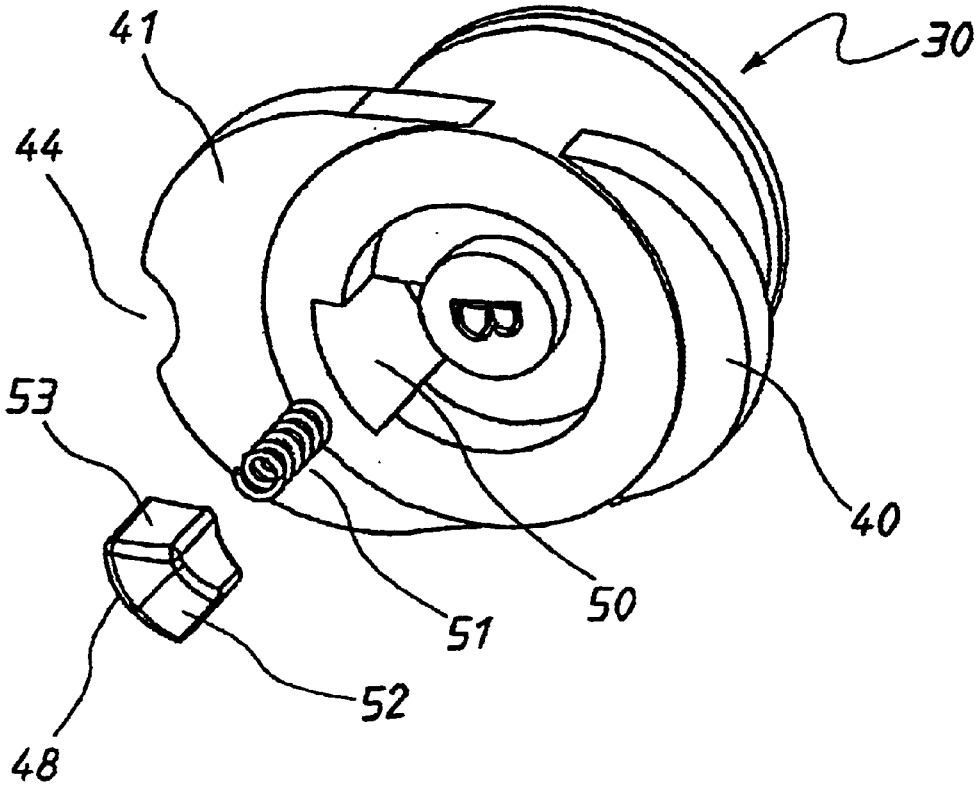
FIG. 10 is a further schematic perspective view of the cam member of FIG. 9.

In operation of the above lock 10 the cylinders 24 and 27, and lever 17 are operated to cause movement of the tongue member 15. However, the lever 17 can only be used to move the tongue 15 if the cam follower 36 does not have its projection 58 engaged in the recess 57. Engagement of the projection 58 within the recess 57 is determined by the position of the cam member 30. When the cam 41 is engaged with the surface 42 and more particularly the surface 42 located in the recess 44, the cam follower 36 is positioned radially outwardly with respect to the recess 57 and therefore the tongue member 15 is free to be moved by operation of the lever 17. Relative movement between the tongue member 15 and cam member 30 is permitted due to the angular extent of the recess 34 and movement of the projection 33 there along. This first operative configuration of the lock mechanism 16 is best seen in FIG. 5, FIG. 6 and FIG. 10.

The cylinders 24 and 27 are both operable to angularly move the cam member 30 to the position at which the surface 42 is engaged in the recess 44. However, only cylinder 27 is operable to move the cam member 30 to displace the cam 41 from the surface 42. When so displaced the projection 58 is free to move into engagement with the recess 57. When the recess 57 is aligned with the projection 58, engagement will occur due to the spring 39 urging the cam follower 36 toward the cam member 30. When this engagement occurs the tongue 15 cannot be operated by means of the lever 17. The cylinder 24 cannot be used to move the recess 44 from engagement with the surface 42 due to operation of the pawl 48. For example, if a key was inserted in the cylinder 24 and rotated in the direction of the arrow 56, the projection 54 would engage the ramp surface 52 to push the pawl 48 inwardly and prevent the cam member 30 from being driven. Ultimately, the projection 33 would engage an extremity of the recess 34 so that no further angular movement of the cam member 30 can occur. Thus the projection 58 remains in the recess 57. If the cylinder 24 is rotated in the opposite direction to the arrow 56, the projection 55 engages the surface 53 and drives the cam member 30. As the cam member 30 angularly moves, the cam 41 removes the projection 58 from within the recess 57 by engagement with the surface 42. Thus the tongue member 15 is free for pivoting movement by use of the lever 17. However, further rotation of the key will cause movement of the tongue member 15 from the extended position to the retracted position by engagement of the projection 33 with the extremity of the recess 34. Thus the cylinder 24 can only be used to move the mechanism 16 from a configuration in which the tongue member 15 is retained in the extended position, to a configuration at which the tongue member 15 is free to be operated by the lever 17. The cylinder 24 cannot be used to move the mechanism 16 to the configuration in which the projection 58 is engaged within the recess 57.

The cylinder 27 can be used to arrange the mechanism 16 in either of the above-described configurations. That is, the cylinder 27 can be operated to move the cam 30 to release the cam follower 36 for engagement with the recess 44, or alternatively, move the cam member 30 to a position removing the projection 58 from within the recess 57 whereupon further angular movement of the key will move the tongue member 15 to the retracted position by engagement of the projection 33 with the extremity of the angular recess 34.

The base 13 is provided with a pair of projections 64 and 65 that engage the lever 17 and define the two positions thereof, that is, the extended position and the retracted position of the tongue member 15.

It should be further appreciated that operation of the cylinder 27 to move the recess 44 into alignment with the surface 42 also frees the lever 17 for operation. Accordingly, a user entering from the outside with a key can close the door without fear of being locked in as the lever 17 is fee for operation. The lever 17 can only be rendered inoperative by actuation of the cylinder 27, not the cylinder 24.

That is when the cylinder 24 is on the inside of a door, the cylinder 24 can only be operated to reader the lever 17 operative to retract the tongue member 15. The cylinder 27 on the outside of the door can be operated to render the lever 17 inoperative and to lock the tongue member 15 in the extended position. The cylinder 27 can also be operated to render the lever 17 operable to retract the tongue member 15 and also to retract the tongue member 15.

The claims defining the invention are as follows:

1. A lock including:

a lock tongue member movable between an extended striker engaging position and a retracted position;

an actuator on a first side of said lock and which is manipulated by a user to move the tongue member from the extended position to the retracted position;

a lock mechanism operatively associated with said actuator and being arrangable in a first configuration and a second configuration, said mechanism wherein said first configuration permitting operation of said actuator to move the tongue member from the extended position to the retracted position, while wherein said second configuration rendering said actuator ineffective in respect of moving said tongue member from said extended position to said retracted position;

a first key operable lock cylinder, said first cylinder being on said first lock side and operatively associated with said lock mechanism;

a second key operable lock cylinder, said second cylinder being on a second side of said lock and operatively associated with said lock mechanism; and wherein said lock mechanism is responsive to operation of said first cylinder by a user to be arranged in said first configuration but not said second configuration, while being responsive to operation of said second cylinder by a user to be arranged by choice of said user in said first configuration or said second configuration.

2. The lock of claim 1 wherein the tongue member includes a tongue portion and a base portion, with the base portion mounting the tongue member for angular movement between the extended and the retracted positions of the tongue member, with the tongue portion being of a hook configuration.

3. The lock of claim 2 further including a projection movable, relative to the tongue member, between a first position retaining the tongue member in the extended position and providing said second configuration, and a second position permitting movement of the tongue member and providing said first configuration, and a cam member mounted for angular movement to cause movement of the projection between the first and second positions thereof, with said cam member and projection being part of said lock mechanism and moved by operation of the first and second cylinders.

4. The lock of claim 3 wherein each cylinder includes a barrel, with the barrels, tongue member and cam member being angularly movable about a common axis.

5. The lock of claim 3 further including a pawl mounted on said cam member, the pawl being adapted to prevent operation of said first cylinder to arrange said lock mechanism in said second configuration.

6. The lock of claim 5 wherein said pawl is movable parallel to said axis between a first position at which said cam member is movable by said first cylinder, and a second position at which said first cylinder is incapable of moving said cam member.

7. The lock of claim 6 wherein said first cylinder when moved angularly in a first direction moves the pawl to the pawl second position so that angular movement of the first cylinder in said first direction does not move said cam member, while angular movement of said first cylinder in the opposite angular direction to said first direction causes engagement of the first cylinder with the pawl to thereby move the cam member and thus movement of said projection from the projection first position to the projection second position.

8. The lock of claim 7 further including a spring urging said pawl in the pawl first position.

9. The lock of claim 8 further including a spring urging said projection to the first position thereof.

10. The lock of claim 1 further including:

a recess in said tongue member;

a projection movable with respect to said tongue member between a first position at which the projection is located in the recess preventing movement of the tongue member and thus providing said second configuration, and a second position spaced from the recess so as to permit movement of the tongue member and thus providing said first configuration;

a cam member operatively associated with the projection to cause movement of the projection between the first and the second positions thereof; and wherein the first cylinder is operatively associated with the cam member so that the cam member can only be driven in one rotational direction by the first cylinder, with angular movement of the cam member in said one direction providing for movement of the cam member to cause movement of said projection to release the tongue member, while said second cylinder is operatively associated with the cam member so as to be operable to drive the cam member in both rotational directions to thereby provide for movement of said projection to either of the positions thereof.

11. The lock of claim 10 further including a pawl mounted on said cam member, the pawl being adapted to prevent operation of said first cylinder to arrange said lock mechanism in said second configuration.

12. The lock of claim 11 wherein said cam member is angularly moved about an axis, and said pawl is movable parallel to said axis between a first position in which the cam member is movable by said first cylinder, and a second position at which said first cylinder is incapable of moving said cam member.

13. The lock of claim 1 wherein rotational operation of the said first lock cylinder in one angular direction only, changes the operative configuration of the lock mechanism, while rotational operation of said second lock cylinder in either angular direction changes the operative configuration of said lock mechanism.

14. The lock of claim 13 further including a projection movable, relative to the tongue member, between a first position retaining the tongue member in the extended position and providing said second configuration, and a second position permitting movement of the tongue member and providing said first configuration, and a cam member mounted for angular movement about an axis and to cause movement of the projection between the first and second positions thereof, with said cam member and projection being part of said lock mechanism and moved by operation of the first and second cylinders.

15. The lock of claim 14 further including a pawl mounted on said cam member, the pawl being adapted to prevent operation of said first cylinder to arrange said lock mechanism in said second configuration.

16. The lock of claim 15 wherein said pawl is movable parallel to said axis between a first position at which said cam member is movable by said first cylinder, and a second position at which said first cylinder is incapable of moving said cam member.

17. The lock of claim 16 wherein said tongue member pivots about said axis to move between the tongue extended and retracted positions.

18. The lock of claim 17 wherein the lock cylinders are co-axial with respect to said axis.

19. The lock of claim 1 wherein said actuator is rendered ineffective to move the tongue to the retracted position by said tongue member being retained in the extended position.

20. The lock of claim 18 wherein said actuator is a lever that pivots about said axis to move the tongue member.

* * * * *